US005839136A

United States Patent [19]

Vance et al.

[11] Patent Number: 5,839,136

[45] Date of Patent: Nov. 24, 1998

[54] COT MOUNTABLE ARM REST AND COT INCORPORATING SAME

[75] Inventors: Ronald D. Vance, Wilmington, Ohio; H. Clayton Johnson, Madison, Ala.

[73] Assignee: Ferno-Washington, Inc., Wilmington, Ohio

[21] Appl. No.: 862,349

[22] Filed: May 23, 1997

[51] Int. Cl.[6] ..... A47C 20/02; A61G 7/075

[52] U.S. Cl. ..... 5/623; 5/646; 128/878; 297/411.23; 297/411.25

[58] Field of Search ..... 5/643, 623, 646, 5/647; 128/878, 879; 297/411.23, 411.25, 411.29

[56] References Cited

U.S. PATENT DOCUMENTS

| | | | |
|---|---|---|---|
| 1,602,877 | 10/1926 | Brixner | 5/646 |
| 2,972,505 | 5/1961 | Weickgenannt | 5/646 |
| 3,528,413 | 9/1970 | Aydt | 5/647 X |
| 4,913,393 | 4/1990 | Wood | 297/411.23 X |
| 4,982,744 | 1/1991 | Stanec | 128/877 |
| 5,025,801 | 6/1991 | Callaway | 128/877 |
| 5,135,210 | 8/1992 | Michelson | 5/623 X |
| 5,154,331 | 10/1992 | Sanders | 224/42.46 |
| 5,347,668 | 9/1994 | Manning | 5/643 X |
| 5,443,233 | 8/1995 | Kabanek | 248/118 |
| 5,505,412 | 4/1996 | Van Hamme | 248/118 |
| 5,522,100 | 6/1996 | Schilling et al. | 5/86.1 |
| 5,630,428 | 5/1997 | Wallace | 5/623 X |

*Primary Examiner*—Michael F. Trettel
*Attorney, Agent, or Firm*—Killworth, Gottman, Hagan & Schaeff, L.L.P.

[57] ABSTRACT

A cot incorporating an cot mounted armrest is provided. The cot mounted arm rest includes a cot frame attaching member, an arm board, and a pivot assembly coupling the attaching member and the arm board. The cot frame attaching member is attached to a backrest frame of the cot and is movable along a portion of the backrest frame. The cot frame attaching member and an arm board are mechanically coupled via an arm board release mechanism. The pivot assembly includes a first pivot assembly portion mechanically coupled to the cot frame attaching member and a second pivot assembly portion mechanically coupled to the arm board. The pivot assembly permits movement of the arm board between an extended arm board position and a retracted arm board position. The extended arm board position is characterized by contact of a frame engaging surface of the arm board with a guardrail frame portion of the cot. The retracted arm board position is characterized by substantially parallel alignment of the arm board and the backrest frame portion.

25 Claims, 11 Drawing Sheets

COT MOUNTABLE ARM REST AND COT INCORPORATING SAME

BACKGROUND OF THE INVENTION

The present invention relates to a cot mountable arm rest, and more particularly, to a cot including an arm rest mounted to a backrest frame portion of the cot.

Ambulatory and medical cots are utilized in patient transport. It is frequently necessary to administer medication or other fluids intravenously during transport by inserting a tube into the arm or the back of the hand of the patient. To avoid injury and ensure proper administration, it is important for the patient's arm and hand to remain relatively immobile. This is particularly important in a moving ambulance, where close quarters and abrupt movements combine to produce a potentially hazardous environment. Accordingly, there is a need for a device which provides for convenient and effective immobilization of a patient's hand or arm during transport on a cot and which does so in close quarters and with minimal disruption of other working environments.

Many cots include an adjustable backrest whereby the patient in transport may be reclined in a completely horizontal position, positioned upright in a sitting position, or placed in a position somewhere between horizontal and upright. Accordingly, there is a further need for a device which provides for convenient and effective immobilization of a patient's hand or arm regardless of the position of the backrest of a cot and regardless of whether the position of the backrest is changed during transport.

BRIEF SUMMARY OF THE INVENTION

This need is met by the present invention wherein a cot mounted arm rest and a cot incorporating the cot mounted arm rest are provided such that a patient's hand and arm may be conveniently and effectively immobilized with minimal disruption to the immediately adjacent environment. Further, the arm rest of the present invention provides for convenient replacement and removal of an arm board portion thereof. The arm rest includes a cot frame attaching member, an arm board, and a pivot assembly which permits movement of the arm board between an extended arm board position and a retracted arm board position.

In accordance with one embodiment of the present invention, a cot is provided comprising an undercarriage, a cot frame overlying the undercarriage, a cot frame attaching member attached to a backrest frame portion of the cot, an arm board, and a pivot assembly. The pivot assembly includes a first pivot assembly portion mechanically coupled to the cot frame attaching member and a second pivot assembly portion mechanically coupled to the arm board. The pivot assembly permits movement of the arm board between an extended arm board position and a retracted arm board position.

The extended arm board position may be characterized by contact of a frame engaging surface of the arm board with a guardrail frame portion of the cot. The retracted arm board position may be characterized by substantially parallel alignment of the arm board and the backrest frame portion. The cot may further comprise an arm board stowage coupled to the backrest frame portion.

The cot frame attaching member is preferably movable along a portion of the backrest frame portion and may further be movable about a longitudinal axis of the backrest frame portion. The cot frame attaching member may include a locking mechanism arranged to prevent movement of the cot frame attaching member. The locking mechanism may comprise a clip, a resilient flexing member, and a locking piece wherein the clip is mechanically coupled to the locking piece via the resilient flexing member.

The arm board preferably includes a frame engaging surface contoured to enclose a portion of the guardrail frame portion. The contoured frame engaging surface may include guardrail securing projections. A guardrail securing fastener may be positioned to secure the guardrail frame portion adjacent the frame engaging surface.

The pivot assembly is preferably designed to support the arm board in a self-supporting position wherein the self-supporting position corresponds to extension of the arm board a predetermined range beyond the extended arm board position, e.g., about 15° to about 45° below horizontal. The pivot assembly may include a twistable arm board mounting assembly arranged to permit the arm board to flex about an axis perpendicular to a pivot axis of the pivot assembly.

In accordance with another embodiment of the present invention, a cot mountable arm rest is provided comprising a cot frame attaching member, an arm board, and a pivot assembly. The pivot assembly includes a first pivot assembly portion mechanically coupled to the cot frame attaching member and a second pivot assembly portion mechanically coupled to the arm board. The arm board is pivotable relative to the cot frame attaching member.

The attaching member may comprise a dual finger clamp including first and second opposing substantially C-shaped fingers, each of the opposing substantially C-shaped fingers extending from a base portion of the clamp, the opposing substantially C-shaped fingers collectively defining a substantially cylindrical cavity extending from the first finger to the second finger. The first and second fingers are preferably spaced apart along a line parallel to the axis of symmetry of the cylindrical cavity by a spacing distance substantially equal to a diameter of the cylindrical cavity.

The cot frame attaching member and the arm board are preferably mechanically coupled via an arm board release mechanism. The arm board release mechanism may be selected from the group consisting of a pull pin, a pull pin positioned along a pivot axis of the pivot assembly, and a pressure-fit coupling.

The arm board may comprise an arm board base, an arm rest, and an arm rest attachment positioned to affix the arm rest to the arm board base. The arm rest attachment may comprise a hook-and-loop fastening strip having complementary fastening portions affixed to the arm board base and the arm rest. Alternatively, the arm board may comprise an arm rest pressure fit within or about an arm board frame. Further, the arm board may include a groove having at least one mounting void, wherein the second pivot assembly portion includes an insert having at least one mounting projection, and wherein the insert and the mounting projection are sized so as to form a pressure-fit engagement with the arm board groove and the at least one mounting void.

The arm board may include a soft touch arm engaging surface and a plurality of slots positioned so as to permit passage of an arm securing strap therethrough. The arm engaging surface may be contoured so as to cradle a patient's arm and may include a molded finger grip formed on a surface opposite the arm engaging surface. The arm board is preferably substantially translucent to imaging radiation and may include an oximeter positioned to measure the blood oxygen content of a patient. The oximeter may be positioned to move from an active to an inactive position wherein the active position is proximate a finger of the patient.

Accordingly, it is an object of the present invention to provide a cot and a cot mountable arm rest which cooperate to effectively and comfortably immobilize a patient's hand and arm regardless of the positioning or location of the cot. Further, it is an object of the present invention to provide a cot mountable arm rest which permits convenient removal and replacement of an arm board portion of the arm rest.

DETAILED DESCRIPTION OF THE INVENTION

Figure 1A:
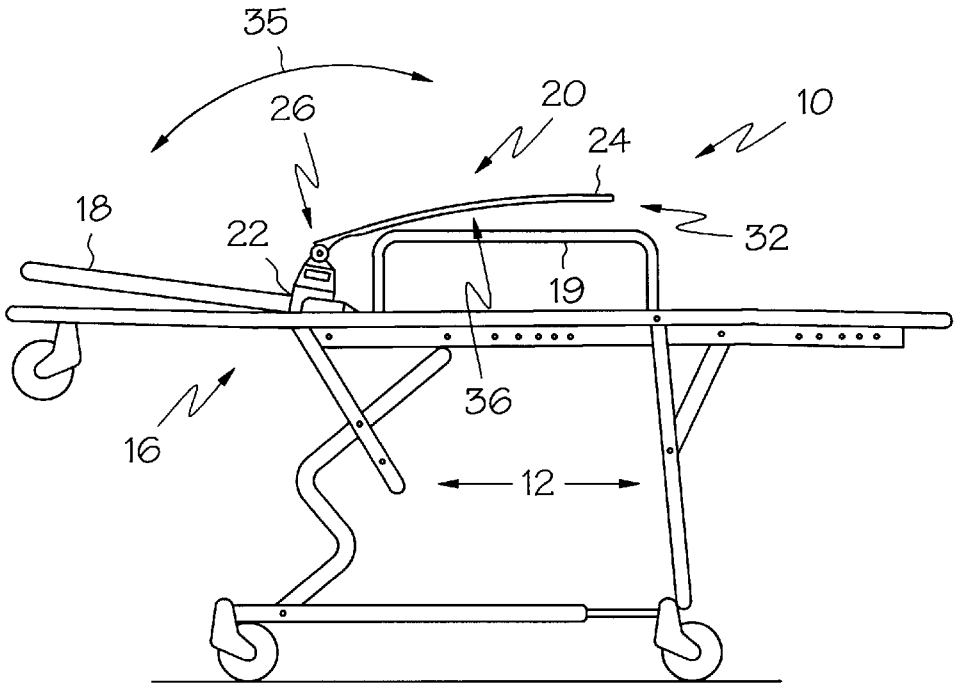
FIGS. 1A, 1B, 1C, and 1D illustrate a cot incorporating a cot mountable arm rest according to the present invention.
Figure 1B:
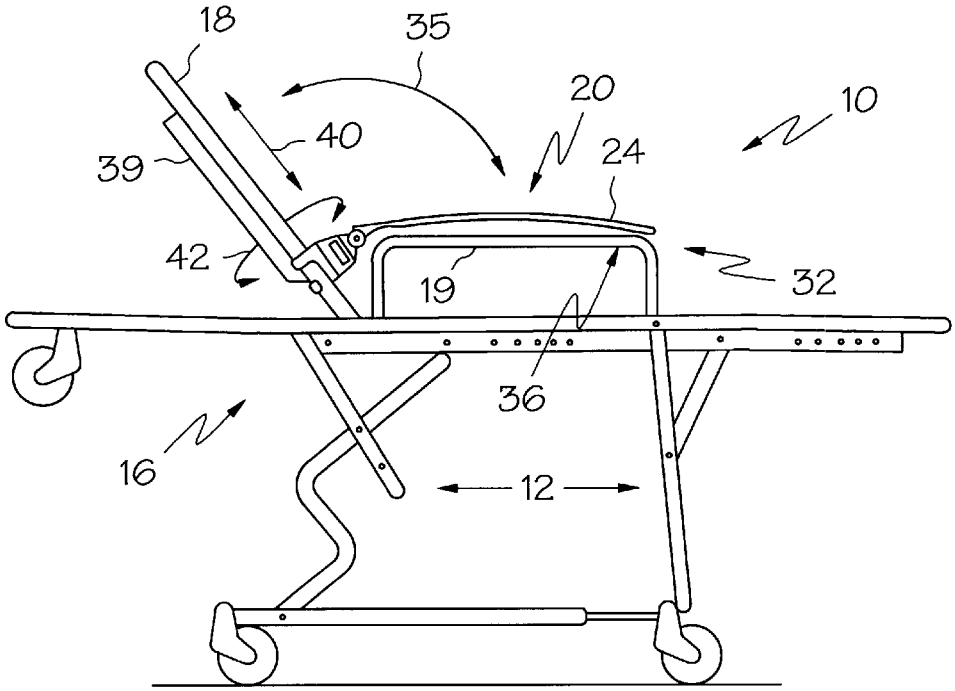

A cot 10 incorporating a cot mountable arm rest 20 according to the present invention is illustrated in FIGS. 1A–1D and 2A–2B. The cot 10 includes an undercarriage 12. A cot frame 16 overlies the undercarriage 12 and includes a backrest frame portion 18. The cot mountable arm rest 20 includes a cot frame attaching member 22 attached to the backrest frame portion 18, an arm board 24, and a pivot assembly 26.

The pivot assembly 26 includes a first pivot assembly portion 28 mechanically coupled to the cot frame attaching member 22 and a second pivot assembly portion 30 mechanically coupled to the arm board 24. The pivot assembly 26 permits movement of the arm board 24 between an extended arm board position 32, see FIGS. 1A and 1B, and a retracted arm board position 34, see FIG. 1D, as indicated by first directional arrows 35. This movement also enables positioning of the arm board 24 in a comfortable position regardless of the orientation of the backrest frame portion 18. It is noted that, for the purposes of describing the present invention, the cot 10 and the cot mountable arm rest 20 illustrated in FIGS. 1A–1D are not illustrated in precise scale. Further, it is contemplated that the relative dimensions, design, and positioning of the cot 10 and the cot mountable arm rest 20 will vary within the scope of the present invention depending upon the particular use of the cot 10 and according to the design preferences of one skilled in the art.

Figure 5:
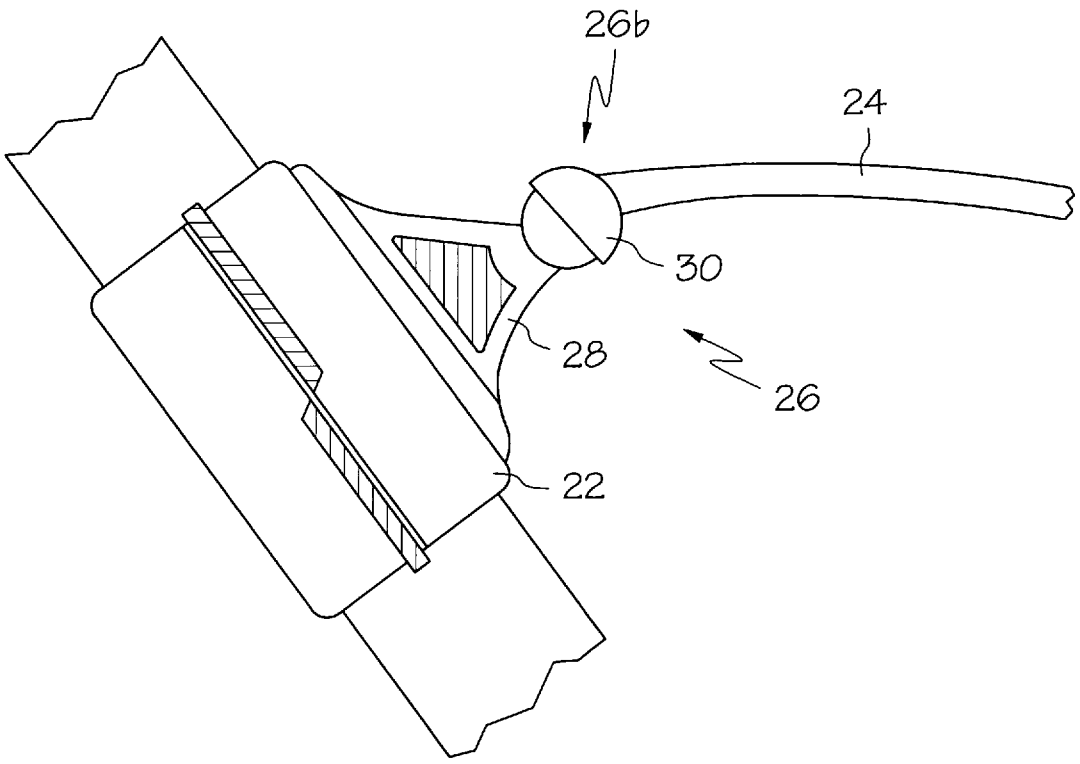
FIG. 5 is a plan view, broken away, of a ball-and-socket joint pivot assembly for a cot mountable arm rest according to the present invention.
Figure 6:
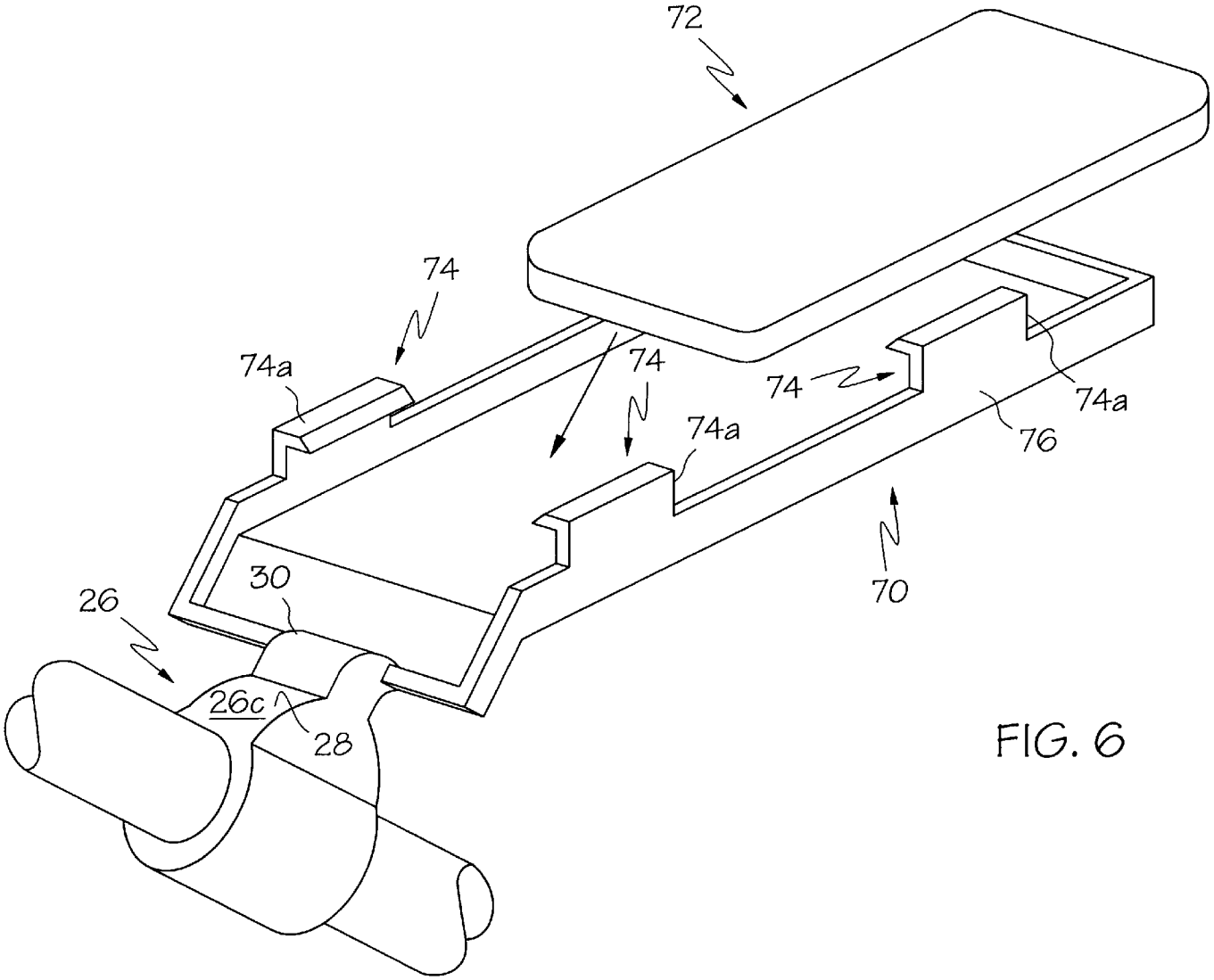
FIG. 6 is a perspective view of an arm board base, an arm rest, and an arm rest attachment according to the present invention.
Figure 7A:
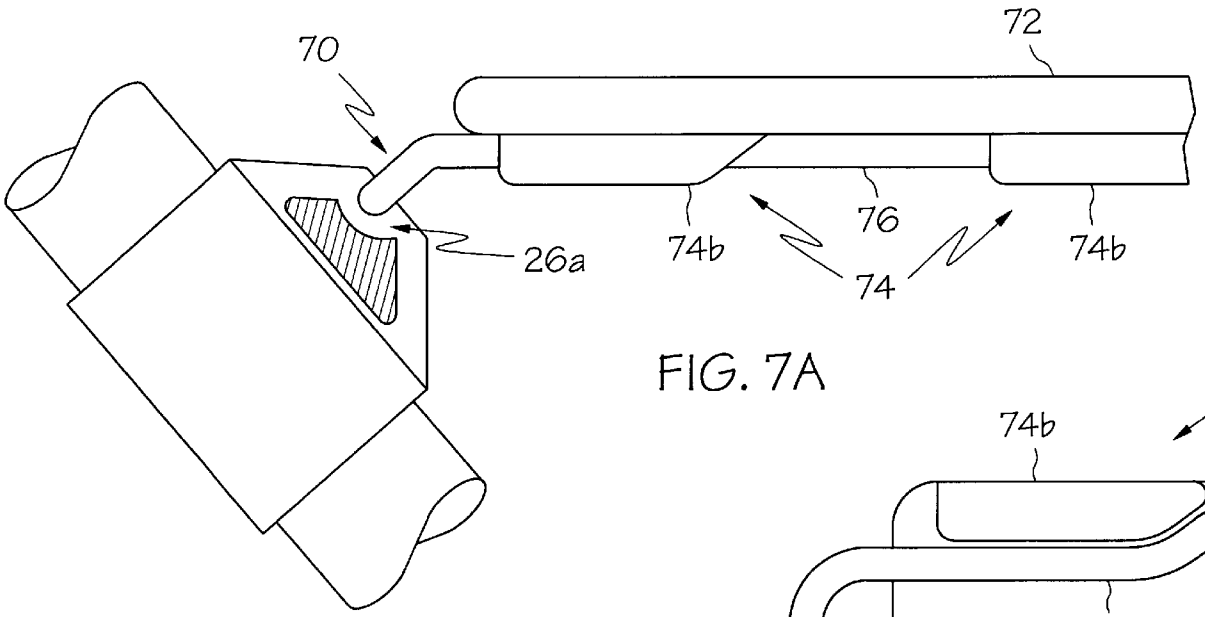
FIGS. 7A and 7B are side and bottom plan views, respectively, of arm board base, an arm rest, and an arm rest attachment according to the present invention.
Figure 7B:
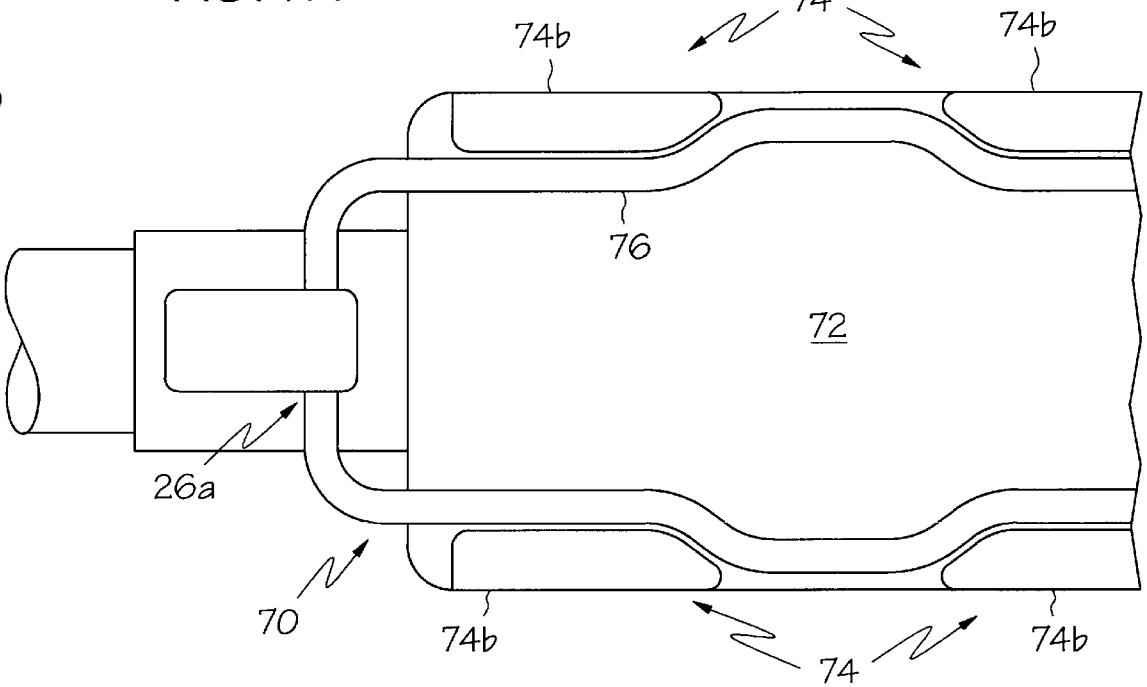
Figure 8C:
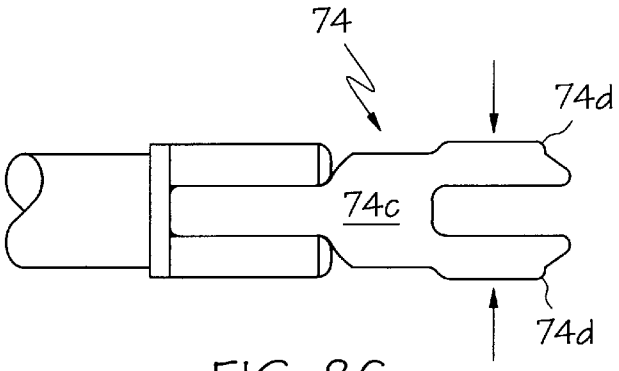
FIG. 8C is a top plan view of an arm rest attachment included within the cot mountable arm rest illustrated in FIGS. 8A and 8B according to the present invention.
Figure 8A:
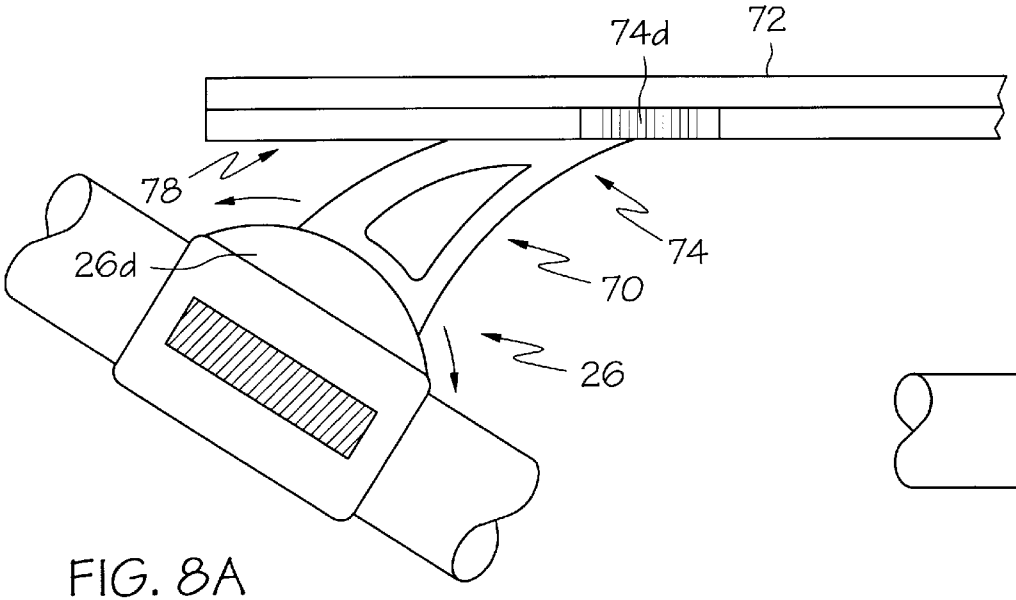
FIGS. 8A and 8B are side plan views of an assembled and a disassembled cot mountable arm rest according to the present invention.
Figure 8B:
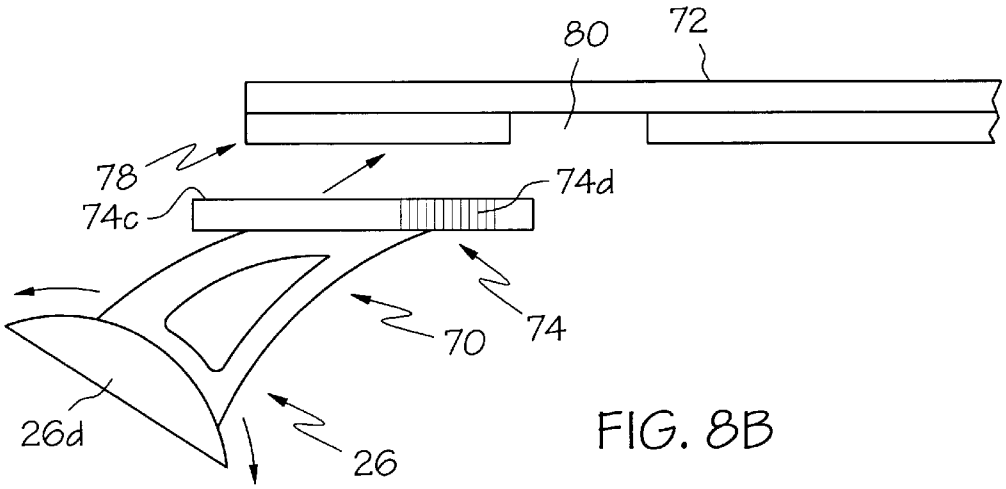

The pivot assembly 26, as referred to herein, may comprise any of a variety of pivot arrangements including, but not limited to, the arrangements described herein. For example, the pivot assembly 26 may comprise an axial pivot 26*a*, see FIGS. 2A, 2B, 4, 7A, and 7B, a ball-and-socket joint 26*b*, see FIG. 5, a living hinge 26*c*, where the first pivot assembly portion 28 and the second pivot assembly portion 30 are defined by a single integral piece of resilient flexible material, see FIGS. 6 and 9, a sliding pivot 26*d*, see FIGS. 8A and 8B, or any other hinge, pivot, or joint arrangement. Further, the first pivot assembly portion 28 may be integral with the cot frame attaching member 22 and the second pivot assembly portion 30 may be integral with the arm board 24. For example, with reference to the ball-and-socket joint 26*b* illustrated in FIG. 5, the first pivot assembly portion 28 is integral with the cot frame attaching member 22. Similarly, with further reference to FIG. 5, the second pivot assembly portion 30 is integral with the arm board 24.

The cot frame 16 further includes a guardrail frame portion 19 and the arm board 24 further includes a frame engaging surface 36. The frame engaging surface 36 is contoured to form a groove 38 and enclose a portion of a guardrail frame portion 19. A frame engaging surface, as referenced herein, comprises an arm board surface positioned to contact a portion of a cot frame when the arm board 24 is mechanically coupled to the cot frame. The extended arm board position 32 is characterized by contact of the frame engaging surface 36 with the guardrail frame portion 19. The retracted arm board position 34 is characterized by substantially parallel alignment of the arm board 24 and the backrest frame portion 18.

According to one aspect of the present invention, the frame engaging surface 36 includes a guardrail securing fastener, e.g., guardrail securing projections 37, positioned to secure the guardrail frame portion 19 adjacent the frame engaging surface 36. Specifically, the guardrail securing projections 37 extend from side portions of the frame engaging surface 36. The projections 37, which comprise metallic or polymeric material and which may be coupled to the frame engaging surface via a conventional spring loaded mounting arrangement, function to further secure the guardrail frame portion 19 within the frame engaging surface 36. Similarly, the depth of the groove 38 may be increased to further secure the guardrail frame portion 19 within the frame engaging surface 36. A further example of an appropriate supplemental securing arrangement comprises one or more substantially U-shaped pressure-fit clips (not shown) provided within the groove and arranged so as to receive and enclose portions of the guardrail frame portion 19.

Figure 1C:
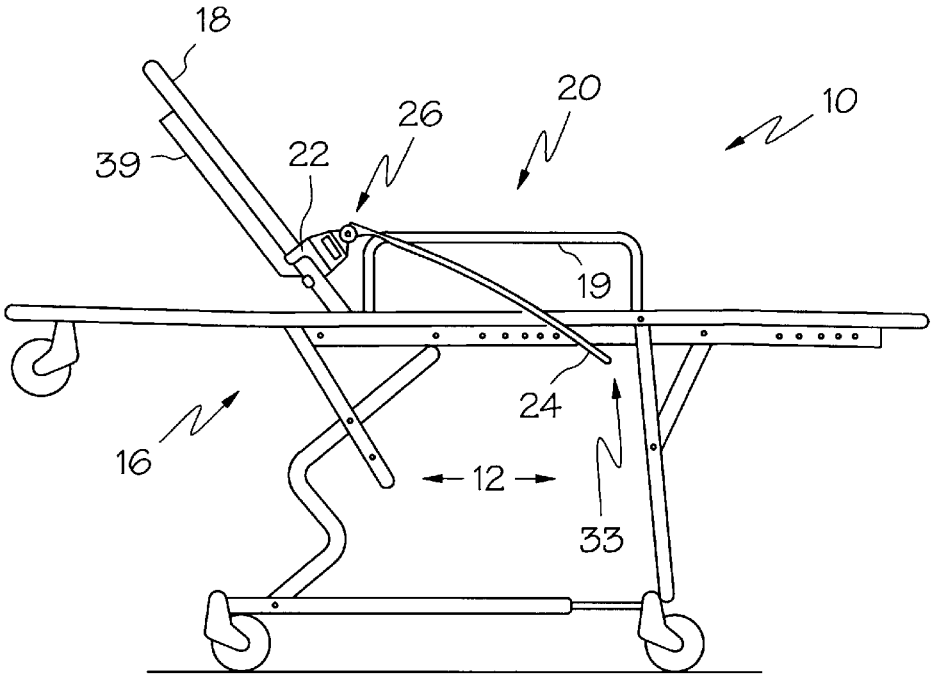
Figure 1D:
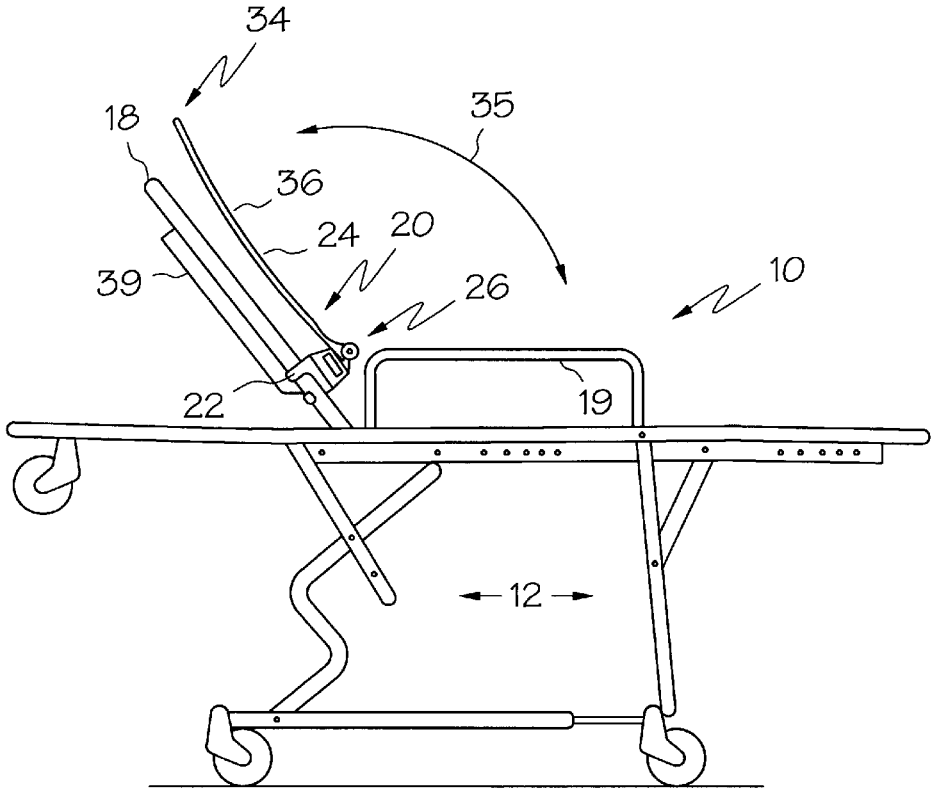

According to another aspect of the present invention, the pivot assembly 26 is designed so as to support the arm board 24 in a self-supporting position 33, see FIG. 1C. The self-supporting position 33 corresponds to extension of the arm board 24 a predetermined range beyond the extended arm board position 32. Specifically, the self-supporting arm board position 33 is typically about 15° to about 45° below horizontal.

Figure 2A:
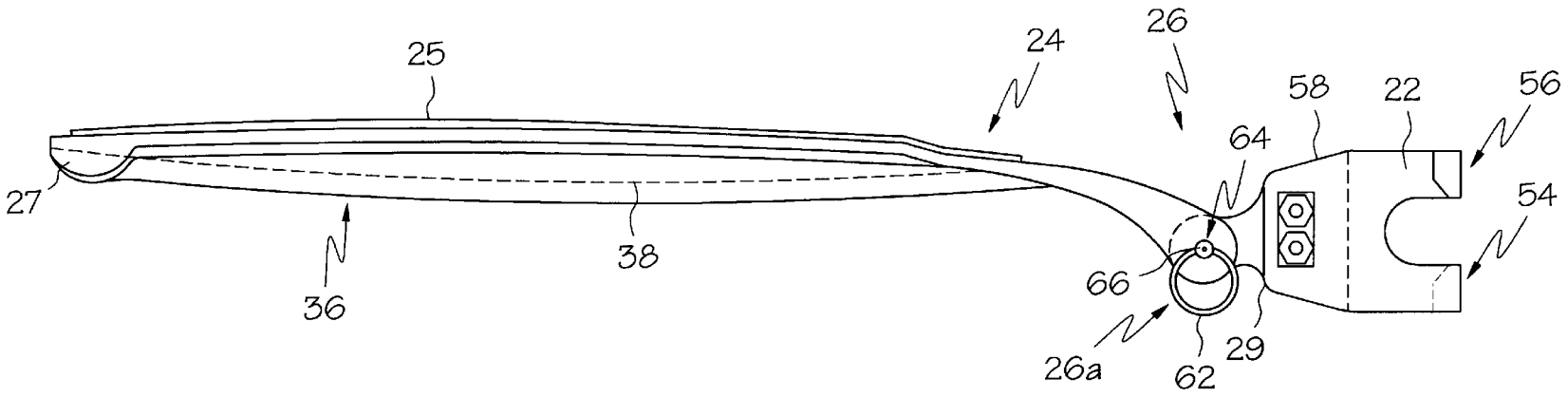
FIGS. 2A and 2B are side and bottom plan views, respectively, of a cot mountable arm rest according to the present invention.
Figure 2B:
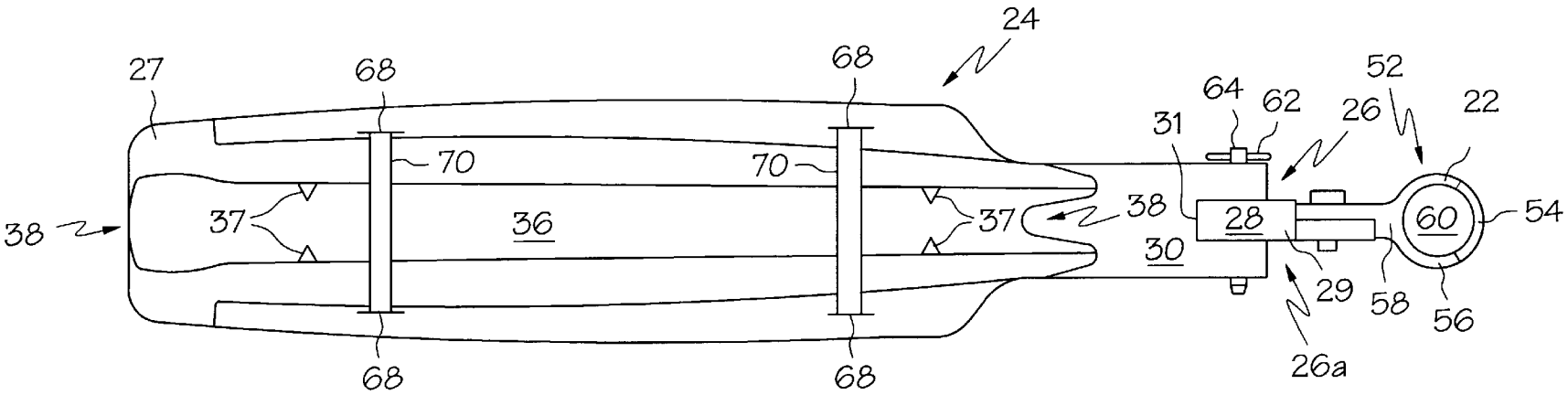

Referring specifically to FIGS. 2A and 2B, an example of structure providing the self-supporting function identified herein comprises an arm board support portion 31 formed in the second pivot assembly portion 30. As the arm board 24 pivots relative to the attaching member 22 towards the self-supporting arm board position 33 a support surface 29 of the first pivot assembly portion 28 is directed towards the arm board support portion 31 so as to contact the arm board support portion 31 when the self-supporting arm board position 33 is reached. Upon contact, the arm board support portion 31 supports the weight of the arm board 24 against the support surface 29 of the first pivot assembly portion 28.

The cot 10 further comprises an arm board stowage 39 coupled to the backrest frame portion 18. The arm board stowage 39 typically comprises a pouch or other container ahold the cot m hold the cot mountable arm rest 20 therein. Alternatively, the arm board 24 alone may be stored in the stowage 39 upon removal of the arm board 24 from the remainder of the cot mountable arm rest 20. Specific examples of arrangements providing for removal of the arm board 24 from the remainder of the cot mountable arm rest 20 are described in detail herein.

The cot frame attaching member 22 is movable along a portion of the backrest frame portion 18, as indicated by second directional arrows 40. Further, to facilitate positioning of the cot frame attaching member 22, the cot frame attaching member 22 is movable about a longitudinal axis of the backrest frame portion 18, as indicated by third directional arrows 42, see FIG. 1B. It is contemplated by the present invention that the cot frame attaching member may comprise any one of a number of suitable arrangements which attach, secure, or clamp the arm rest 20 to the backrest frame portion 18. However, an attaching member which may be installed and removed from the backrest frame portion 18 without disassembling the cot 10 or any portions thereof is preferred.

Figure 3A:
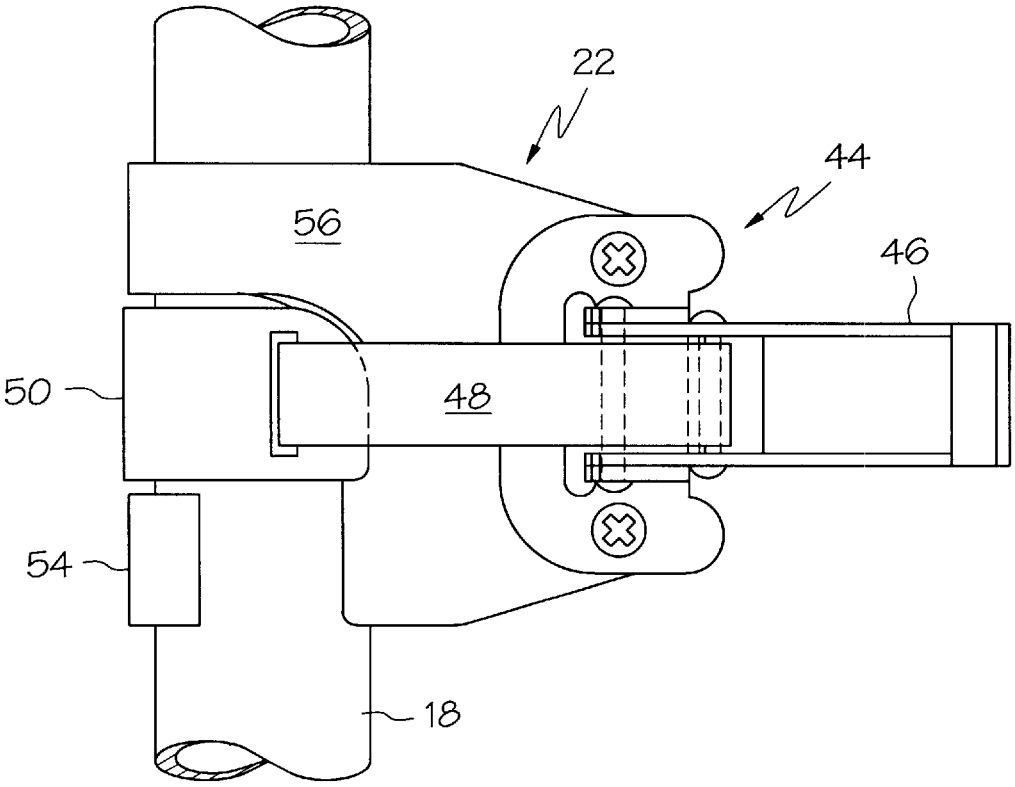
FIGS. 3A and 3B are top and side plan views, respectively, of a cot frame attaching member and locking mechanism therefor according to the present invention.
Figure 3B:
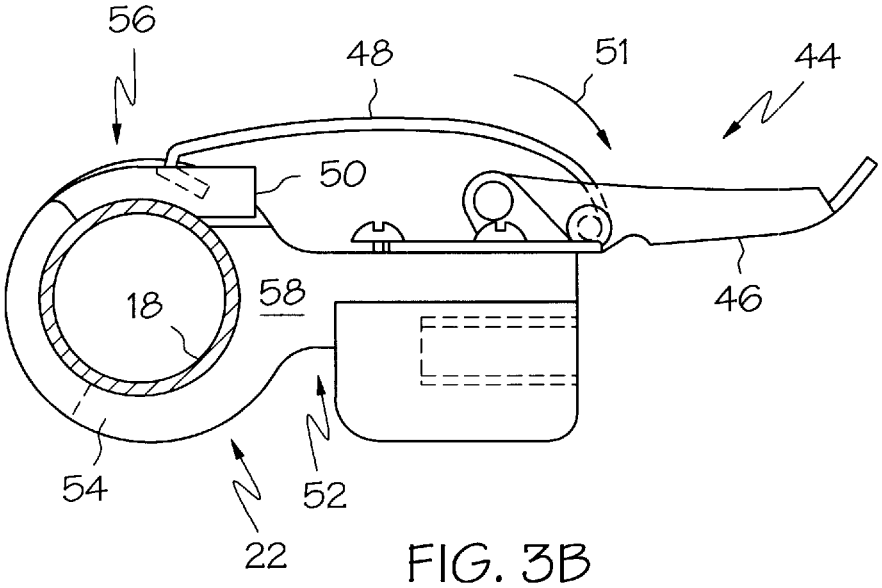
Figure 4:
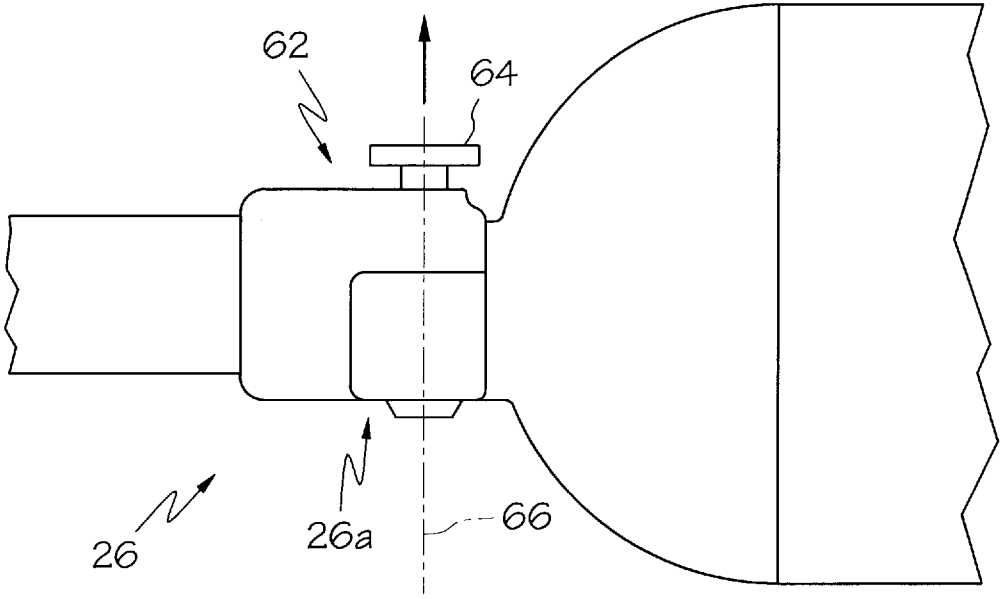
FIG. 4 is a plan view, broken away, of a pivot assembly for a cot mountable arm rest according to the present invention.

According to another aspect of the present invention, the cot frame attaching member 22 includes a locking mechanism 44 arranged to prevent movement of the cot frame attaching member 22. An appropriate locking mechanism 44 is illustrated in FIGS. 3A and 3B and comprises a clip 46, a resilient flexing member 48, and a locking piece 50. The clip 46 is mechanically coupled to the locking piece 50 via the resilient flexing member 48. The locking piece 50 is shaped to conform to the exterior shape of the backrest frame portion 18 and is forcibly urged against the backrest frame portion 18 when the resilient flexing member is placed under tension as the clip 46 moves towards a locked position, see fourth directional arrow 51.

The cot mountable arm rest 20 will be described in detail with reference to FIGS. 2A–10B wherein a plurality of arm rest design alternatives are illustrated. In the embodiment illustrated in FIGS. 2A–2B and 3A–3B, the cot frame attaching member 22 comprises a dual finger clamp 52 including a first substantially C-shaped finger 54 and a second substantially C-shaped finger 56 positioned to oppose the first substantially C-shaped finger 54. Each of the opposing substantially C-shaped fingers 54, 56 extend from a base portion 58 of the clamp 52. The opposing substantially C-shaped fingers 54, 56 collectively define a substantially cylindrical cavity 60, see FIG. 2B, extending from the first finger 54 to the second finger 56. The first and second fingers 54, 56 are spaced apart along a line parallel to the axis of symmetry of the cylindrical cavity 60 by a spacing distance substantially equal to a diameter of the cylindrical cavity 60. The dual finger clamp 52 is available from Ferno-Washington, Inc., Wilmington, Ohio, under the product number FW-0274-601121.

The arm board 24 illustrated in FIGS. 2A and 2B comprises a rigid material capable of supporting a patient's arm, such as, for example, a polymeric resin. The material is also preferably substantially translucent to imaging radiation to permit x-ray and other photographic or diagnostic examination of the arm while the arm is secured to the arm board 24. Further, to improve the functionality of the arm board 24, a contoured soft touch arm engaging surface 25 is provided to comfortably cradle a patient's arm in contact with the arm engaging surface 25. The contoured soft touch arm engaging surface 25 may comprise a foam pad or the softer of two coextruded or pultruded materials forming the arm board 24. A soft touch arm engaging surface, as referred to herein, comprises a surface or material which flexes or yields significantly under the typical weight of a patient's arm so as to provide the patient a degree of added comfort. The arm board 24 also includes a molded finger grip 27 formed opposite the arm engaging surface 25 of the arm board 24 to further increase patient comfort. Finally, a plurality of slots 68 are positioned so as to permit passage of arm securing straps 70 through opposing slots 68.

According to another aspect of the present invention, the cot frame attaching member 22 and the arm board 24 are mechanically coupled via an arm board release mechanism 62. It is contemplated that a variety of arm board release mechanisms, including pressure fit mechanical couplings, may be provided within the scope of the present invention. For example, with reference to FIGS. 2A, 2B, and 4, the arm board release mechanism 62 comprises a pull pin 64 positioned along a pivot axis 66 of the pivot assembly 26. Alternatively, the function of the arm board release mechanism may be provided by a variety of arm board release arrangements, as described below with reference to FIGS. 6–9. Release mechanisms adapted to release the attaching member 22 from the backrest frame portion 18 may also be provided.

Figure 9:
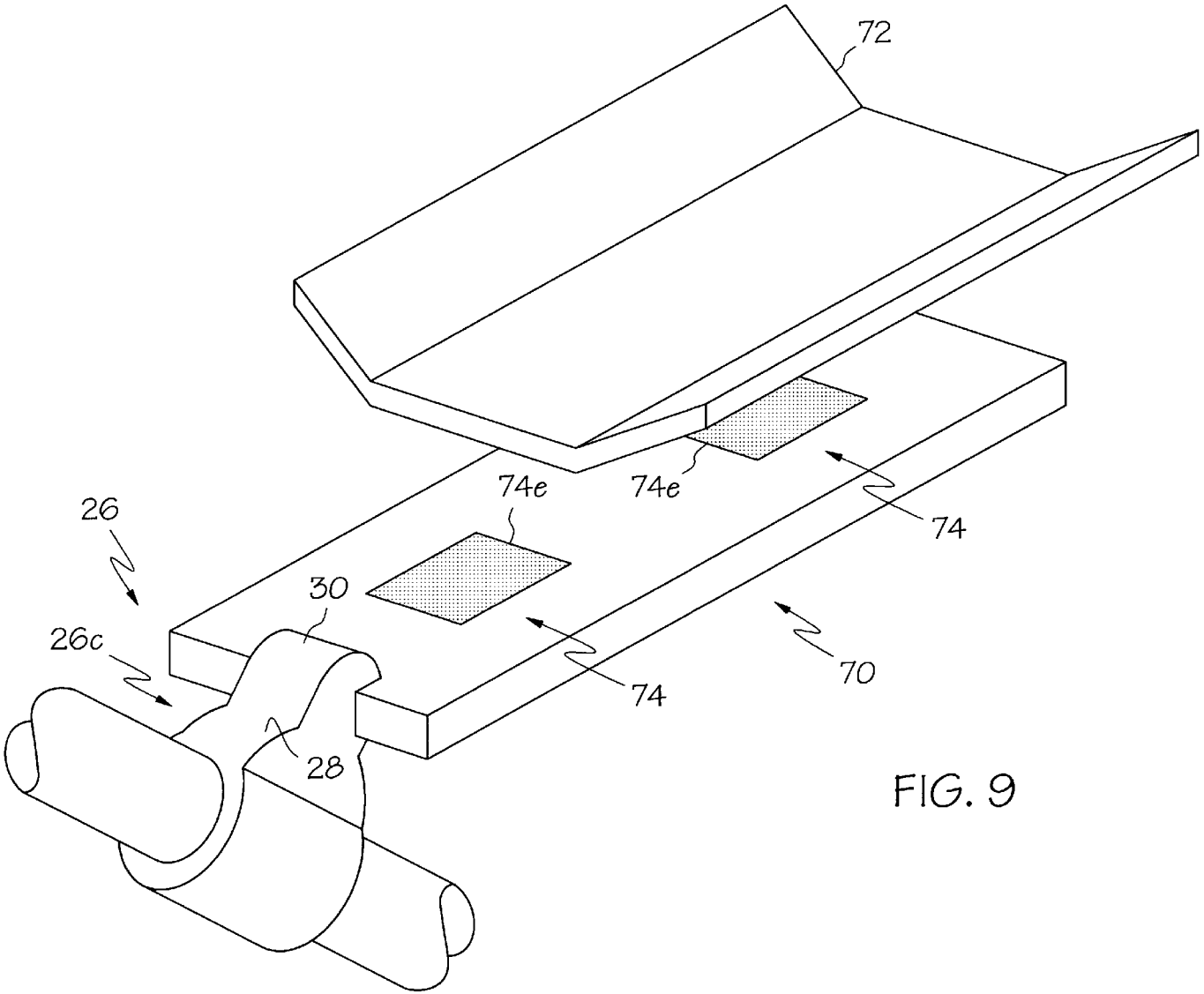
FIG. 9 is a perspective view of an arm board base, an arm rest, and an arm rest attachment according to the present inventions.

Referring now to FIGS. 6–9, according to another aspect of the present invention, the arm board 24 comprises an arm board base 70, a replaceable/disposable arm rest 72, and an arm rest attachment 74 positioned to affix the arm rest 72 to the arm board base 70. Specifically, with reference to FIG. 6, the arm rest attachment 74 comprises a set of flexible resilient clips 74*a* mounted to an arm board frame 76 and the arm rest 72 is die cut such that it may be pressure fit within the flexible resilient clips 74*a*. Alternatively, with reference to FIG. 7A and 7B, the arm rest attachment 74 comprises a set of flexible resilient projections 74*b* shaped so as to be pressure fit about a tubular, 0.25" (0.64 cm) diameter, bent aluminum arm board frame 76. A further alternative is illustrated in FIGS. 8A–8C, where the arm rest attachment 74 comprises an insert 74*c* having at least one mounting projection 74*d*. The insert 74*c* and the mounting projections 74*d* are sized so as to be positionable in a groove or track 78 formed in the arm rest 72 such that the mounting projections 74*d* snap in to a pressure fit engagement with at least one insert receiving mounting void 80 formed in the groove 78. Yet another arm rest attachment alternative is illustrated in FIG. 9, where complementary fastening portions 74*e* of a hook and loop fastening strip are affixed to the arm board base 70 and the arm rest 72.

Figure 10A:
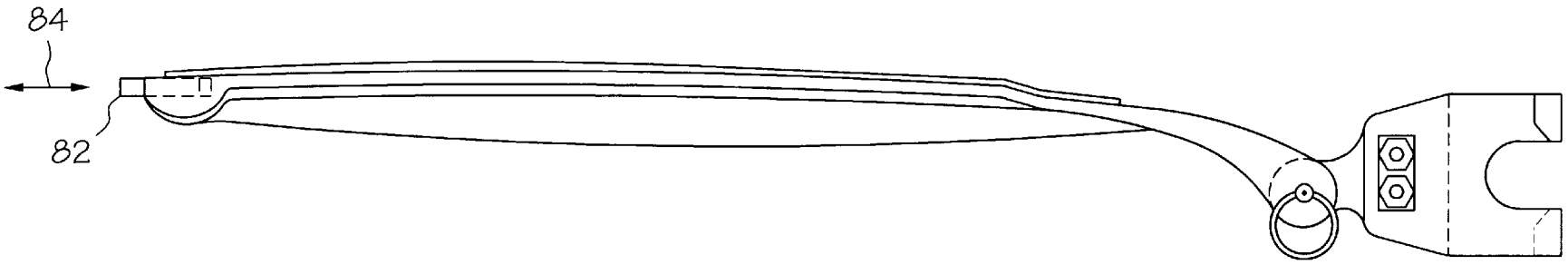
FIGS. 10A and 10B are side and bottom plan views, respectively, of a cot mountable arm rest according to the present invention.
Figure 10B:
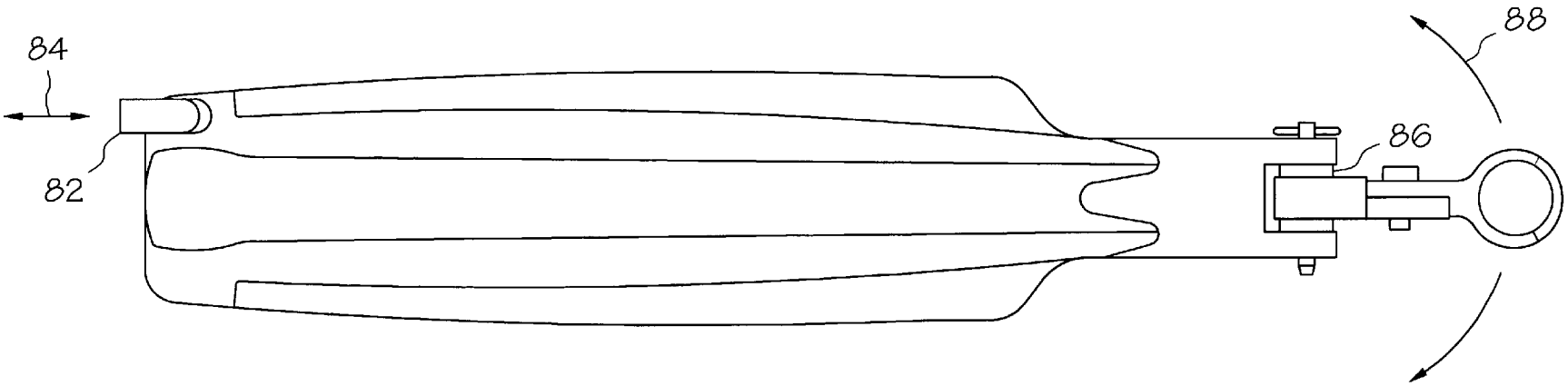

Referring now to FIGS. 10A and 10B, the cot mountable arm rest 20 includes an oximeter 82 positioned to measure the blood oxygen content of a patient having an arm positioned in contact with the arm board 24. The oximeter 82 is positioned to move from an active position proximate a finger of the patient to an inactive position recessed within the arm board 24, as indicated by fifth directional arrow 84.

With further reference to FIGS. 10A and 10B, the cot mountable arm rest 20 includes a twistable arm board mounting assembly 86, e.g. a flexible bushing positioned within the pivot assembly 26, arranged to permit the arm board 24 to flex about an axis perpendicular to a pivot axis of the pivot assembly 26, see sixth directional arrows 88.

Having described the invention in detail and by reference to preferred embodiments thereof, it will be apparent that modifications and variations are possible without departing from the scope of the invention defined in the appended claims.

I claim:

1. A cot comprising:

an undercarriage;

a cot frame overlying said undercarriage, said cot frame including a backrest frame portion;

a cot frame attaching member attached to said backrest frame portion;

an arm board including a frame engaging surface; and a pivot assembly including a first pivot assembly portion mechanically coupled to said cot frame attaching member and a second pivot assembly portion mechanically coupled to said arm board, wherein said pivot assembly permits movement of said arm board between an extended arm board position and a retracted arm board position, and wherein said extended arm board position is characterized by contact of said frame engaging surface with said cot frame.

2. A cot as claimed in claim 1 wherein said retracted arm board position is characterized by substantially parallel alignment of said arm board and said backrest frame portion.

3. A cot as claimed in claim 1 wherein said cot frame attaching member is movable along a portion of said backrest frame portion.

4. A cot as claimed in claim 1 wherein said cot frame attaching member is movable about a longitudinal axis of the backrest frame portion.

5. A cot as claimed in claim 1 wherein said pivot assembly supports said arm board in a self-supporting position and wherein said self-supporting position corresponds to extension of said arm board a predetermined range beyond said extended arm board position.

6. A cot as claimed in claim 5 wherein said self-supporting position is about 15° to about 45° below horizontal.

7. A cot mountable arm rest comprising:

a cot frame attaching member comprising a dual finger clamp including first and second opposing substantially C-shaped fingers, each of said opposing substantially C-shaped fingers extending from a base portion of said clamp, said opposing substantially C-shaped fingers collectively defining a substantially cylindrical cavity extending from said first finger to said second finger;

an arm board; and a pivot assembly including a first pivot assembly portion mechanically coupled to said cot frame attaching member and a second pivot assembly portion mechanically coupled to said arm board, wherein said arm board is pivotable relative to said cot frame attaching member.

8. A cot mountable arm rest as claimed in claim 7 wherein said first and second fingers are spaced apart along a line parallel to the axis of symmetry of said cylindrical cavity.

9. A cot mountable arm rest as claimed in claim 7 wherein said first and second fingers are spaced apart along a line parallel to the axis of symmetry of said cylindrical cavity by a spacing distance substantially equal to a diameter of said cylindrical cavity.

10. A cot mountable arm rest as claimed in claim 7 wherein said pivot assembly includes a twistable arm board mounting assembly arranged to permit said arm board to flex about an axis perpendicular to a pivot axis of said pivot assembly.

11. A cot comprising:

an undercarriage;

a cot frame overlying said undercarriage, said cot frame including a backrest frame portion and a guardrail frame portion;

a cot frame attaching member attached to said backrest frame portion and movable along a portion of said backrest frame portion and about a longitudinal axis of said backrest frame portion;

an arm board including a frame engaging surface and a guardrail securing fastener positioned to secure said guardrail frame portion of said cot frame adjacent said frame engaging surface, wherein said cot frame attaching member and said arm board are mechanically coupled via an arm board release mechanism; and a pivot assembly including a first pivot assembly portion mechanically coupled to said cot frame attaching member and a second pivot assembly portion mechanically coupled to said arm board, wherein said pivot assembly permits movement of said arm board between an extended arm board position and a retracted arm board position, wherein said extended arm board position is characterized by contact of said frame engaging surface with said guardrail frame portion, and wherein said retracted arm board position is characterized by substantially parallel alignment of said arm board and said backrest frame portion.

12. A cot as claimed in claim 11 wherein said pivot assembly supports said arm board in a self-supporting position and wherein said self-supporting position corresponds to extension of said arm board a predetermined range beyond said extended arm board position.

13. A cot mountable arm rest comprising:

a cot frame attaching member;

an arm board including an oximeter positioned to measure the blood oxygen content of a patient having an arm positioned in contact with said arm board; and a pivot assembly including a first pivot assembly portion mechanically coupled to said cot frame attaching member and a second pivot assembly portion mechanically coupled to said arm board, wherein said arm board is pivotable relative to said cot frame attaching member.

14. A cot mountable arm rest as claimed in claim 13 wherein said oximeter is positioned to move from an active to an inactive position and wherein said active position is proximate a finger of said patient.

15. A cot comprising:

an undercarriage;

a cot frame overlying said undercarriage, said cot frame including a backrest frame portion;

a cot frame attaching member attached to said backrest frame portion;

an arm board;

an arm board stowage coupled to said cot; and a pivot assembly including a first pivot assembly portion mechanically coupled to said cot frame attaching member and a second pivot assembly portion mechanically coupled to said arm board, wherein said pivot assembly permits movement of said arm board between an extended arm board position and a retracted arm board position.

16. A cot as claimed in claim 15 wherein said arm board stowage is coupled to said backrest frame portion.

17. A cot comprising:

an undercarriage;

a cot frame overlying said undercarriage, said cot frame including a backrest frame portion and a guardrail frame portion;

a cot frame attaching member attached to said backrest frame portion;

an arm board including a frame engaging surface contoured to enclose a portion of said guardrail frame portion; and a pivot assembly including a first pivot assembly portion mechanically coupled to said cot frame attaching member and a second pivot assembly portion mechanically coupled to said arm board, wherein said pivot assembly permits movement of said arm board between an extended arm board position and a retracted arm board position.

18. A cot as claimed in claim 17 wherein said contoured frame engaging surface includes guardrail securing projections.

19. A cot comprising:

an undercarriage;

a cot frame overlying said undercarriage, said cot frame including a backrest frame portion and a guardrail frame portion;

a cot frame attaching member attached to said backrest frame portion;

an arm board including a frame engaging surface; and a pivot assembly including a first pivot assembly portion mechanically coupled to said cot frame attaching member and a second pivot assembly portion mechanically coupled to said arm board, wherein said pivot assembly permits movement of said arm board between an extended arm board position and a retracted arm board position, wherein said extended arm board position is characterized by contact of said frame engaging surface with said guardrail frame portion.

20. A cot as claimed in claim 14 wherein said arm board includes a guardrail securing fastener positioned to secure said guardrail frame portion adjacent said frame engaging surface.

21. A cot comprising:

an undercarriage;

a cot frame overlying said undercarriage, said cot frame including a backrest frame portion;

a cot frame attaching member attached to said backrest frame portion, wherein said cot frame attaching member includes a locking mechanism arranged to prevent movement of said cot frame attaching member, and wherein said locking mechanism comprises a clip, a resilient flexing member, and a locking piece, and wherein said clip is mechanically coupled to said locking piece via said resilient flexing member;

an arm board; and a pivot assembly including a first pivot assembly portion mechanically coupled to said cot frame attaching member and a second pivot assembly portion mechanically coupled to said arm board, wherein said pivot assembly permits movement of said arm board between an extended arm board position and a retracted arm board position.

22. A cot mountable arm rest comprising:

a cot frame attaching member;

an arm board, wherein said cot frame attaching member and said arm board are mechanically coupled via an arm board release mechanism, and wherein said arm board release mechanism is selected from the group consisting of a pull pin, a pull pin positioned along a pivot axis of said pivot assembly, and a pressure-fit coupling; and a pivot assembly including a first pivot assembly portion mechanically coupled to said cot frame attaching member and a second pivot assembly portion mechanically coupled to said arm board, wherein said arm board is pivotable relative to said cot frame attaching member.

23. A cot mountable arm rest comprising:

a cot frame attaching member;

an arm board comprising an arm rest pressure fit within or about an arm board frame; and a pivot assembly including a first pivot assembly portion mechanically coupled to said cot frame attaching member and a second pivot assembly portion mechanically coupled to said arm board, wherein said arm board is pivotable relative to said cot frame attaching member.

24. A cot mountable arm rest comprising:

a cot frame attaching member;

an arm board; and a pivot assembly including a first pivot assembly portion mechanically coupled to said cot frame attaching member and a second pivot assembly portion mechanically coupled to said arm board, wherein said arm board is pivotable relative to said cot frame attaching member, wherein said arm board includes a groove having at least one mounting void, said second pivot assembly portion includes an insert having at least one mounting projection, and said insert and said mounting projection are sized so as to form a pressure-fit engagement with said arm board groove and said at least one mounting void.

25. A cot mountable arm rest comprising:

a cot frame attaching member;

an arm board including a molded finger grip formed on a surface opposite an arm engaging surface of said arm board; and a pivot assembly including a first pivot assembly portion mechanically coupled to said cot frame attaching member and a second pivot assembly portion mechanically coupled to said arm board, wherein said arm board is pivotable relative to said cot frame attaching member.

* * * * *